US009736905B2

(12) United States Patent
Hilgers et al.

(10) Patent No.: US 9,736,905 B2
(45) Date of Patent: Aug. 15, 2017

(54) BLEEDER CONTROL ARRANGEMENT

(71) Applicant: PHILIPS LIGHTING HOLDING B.V., Eindhoven (NL)

(72) Inventors: Achim Hilgers, Eindhoven (NL); Dmytro Viktorovych Malyna, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/126,130

(22) PCT Filed: Jan. 29, 2015

(86) PCT No.: PCT/EP2015/051767
§ 371 (c)(1),
(2) Date: Sep. 14, 2016

(87) PCT Pub. No.: WO2015/139868
PCT Pub. Date: Sep. 24, 2015

(65) Prior Publication Data

US 2017/0099712 A1 Apr. 6, 2017

(30) Foreign Application Priority Data

Mar. 18, 2014 (EP) ..... 14160493

(51) Int. Cl.
*H05B 33/08* (2006.01)

(52) U.S. Cl.
CPC ..... *H05B 33/0887* (2013.01); *H05B 33/0845* (2013.01)

(58) Field of Classification Search
CPC ..... H05B 33/0815; H05B 33/0809; H05B 33/0824; H05B 33/0845; H05B 37/0263
See application file for complete search history.

(56) References Cited

U.S. PATENT DOCUMENTS 8,508,147 B2 8/2013 Shen
2010/0225251 A1 9/2010 Maruyama
(Continued)

FOREIGN PATENT DOCUMENTS

EP 2590477 A1 8/2013
WO WO2012016197 A1 2/2012
(Continued)

*Primary Examiner* — Monica C King
(74) *Attorney, Agent, or Firm* — Akarsh P. Belagodu

(57) ABSTRACT

The invention describes an analog bleeder control arrangement (1) realized for use between a power supply (4) and a load (3), which bleeder control arrangement (1) is realized to generate a bleeder activation signal (20_on) to activate a bleeder (20) arranged between the power supply (4) and the load (3), and wherein the bleeder activation signal (20_on) is generated only upon detection of a phase-cut edge (LE, FE) on a voltage input signal ($U_{in}$). The invention further describes an LED lamp driver (2), realized to drive a lighting load (3) comprising a number of LED light sources (30) and comprising such a bleeder control arrangement (1). The invention also describes a lighting arrangement (6) comprising an LED lighting load (3); a driver circuit (2) realized to drive the lighting load (3); a bleeder (20) for providing compatibility between a dimmer (5) and the driver (2); and such a bleeder control arrangement (1) realized to activate the bleeder (20) only upon detection of a phase-cut edge (LE, FE) on a power supply input signal ($U_{in}$).

12 Claims, 5 Drawing Sheets

(56) References Cited

U.S. PATENT DOCUMENTS

| | | | |
|---|---|---|---|
| 2011/0193488 | A1 | 8/2011 | Kanamori et al. |
| 2011/0234115 | A1 | 9/2011 | Shimizu et al. |
| 2012/0126714 | A1 | 5/2012 | Deppe et al. |

FOREIGN PATENT DOCUMENTS

| | | | |
|---|---|---|---|
| WO | WO2012031901 | A2 | 3/2012 |
| WO | WO2013064960 | A1 | 5/2013 |
| WO | WO2013136301 | A2 | 9/2013 |

BLEEDER CONTROL ARRANGEMENT

CROSS-REFERENCE TO PRIOR APPLICATIONS

This application is the U.S. National Phase application under 35 U.S.C. §371 of International Application No. PCT/EP2015/051767, filed on Jan. 29, 2015, which claims the benefit of European Patent Application No. 14160493.4, filed on Mar. 18, 2014. These applications are hereby incorporated by reference herein.

FIELD OF THE INVENTION

The invention describes a bleeder control arrangement; an LED lamp driver; and a lighting arrangement.

BACKGROUND OF THE INVENTION

The use of LED-based lamps is becoming more widespread in home and office environments, since LEDs are efficient and can be realized in a wide range of designs and to deliver precise color temperatures. If an LED-lamp is to be connected to an already installed dimmer, it must be compatible to it. Dimmers of the type used between a power supply and a light source are generally leading-edge or trailing-edge phase-cut dimmers. These work by "cutting off" or suppressing a portion of a sinusoidal mains signal in order to reduce the input power to the light source, either at the beginning of a sinusoidal half-wave (leading edge) or at the end of a sinusoidal half-wave (trailing edge) of a full-wave rectified voltage signal. By 'removing' a portion of the input voltage to the lamp, less energy is passed to the following driver electronics. To ensure correct operation of the dimmer, the holding current of the electronic switch needs to be drawn by the lamp's driving electronics (or 'driver') throughout the entire mains cycle. For example, a triac requires a holding current of at least 25-30 mA in order to function correctly. This is easy to achieve by the driver of a lamp comprising an incandescent light source, a halogen light source, etc. However, if an LED (light-emitting diode) lamp is to be operated with an already installed or existing dimmer, it needs to be compatible with the dimmer, i.e. it must be able to cope with the high oscillations generated by the dimmer during the phase edges/cuts and to guarantee a minimum current (the 'holding current') over an entire phase. Furthermore, the light output by the LED lamp must be reduced according to the dimming level, i.e. according to the reduced operating power.

A modern LED driver draws a relatively low average current, which is a problem when the LED driver is to be used in conjunction with a dimmer. LEDs are low-power devices, and the trend is towards even lower power dissipation as the efficiency of LEDs increases. This means that the electronic driver draws a significant current level only at the beginning of a mains cycle, and draws a low current during the remainder of the cycle. As a result, it may be difficult or impossible for the driver of an LED lamp to continuously draw the required minimum holding current. This often leads to misfiring of the phase-cut dimmer, and this in turn can result in undesirable visible flicker in the light output by the LED lamp.

One way to address this problem is to incorporate a 'bleeder' in the dimmer electronics. The bleeder ensures that the driver draws a minimum holding current during the entire mains cycle, independently of the current drawn by the particular LED-driving stage. However, such a bleeder dissipates a significant amount of power, for example in the range of 1.0-2.0 Watt during operation even if there is no dimmer present, or the dimmer is not performing any phase-cut. In some approaches that address the problem of unnecessary power dissipation, digital or mixed-signal circuits are used to detect the presence of a dimmer and/or to detect the activity of a dimmer, and to turn a bleeder on or off as appropriate. However, the need to incorporate such digital or mixed-signal circuitry in a lamp driver adds considerably to its expense.

US 2011/0234115 A1 discloses a LED drive circuit, suitable to be connected to a phase control dimmer. The circuit comprises an edge detection circuit and a current extraction circuit for extracting current from a current feed line for the LED. The value of the current extraction circuit varies in accordance with the detection results of the edge detection circuit. The current extraction circuit may be switched off when no dimmer is present.

Therefore, it is an object of the invention to provide a more efficient and economical way of operating an LED lamp, avoiding the problems mentioned above.

SUMMARY OF THE INVENTION

The object of the invention is achieved by the bleeder control arrangement of claim 1.

According to the invention, the analogue bleeder control arrangement is realized for use between a power supply and a load, and is realized to generate a bleeder activation signal to activate a bleeder arranged between the power supply and the load, which bleeder activation signal is generated only upon detection of a phase-cut edge on a voltage input signal to the bleeder control arrangement. In the context of the invention, the expression "analogue bleeder control arrangement" is to be understood to mean that the bleeder control arrangement is realized using only analogue components, in contrast to other known bleeder activator modules that are realized using microcontrollers and other digital components.

An advantage of the bleeder control arrangement according to the invention is that the bleeder is only activated if a dimmer is present and in use, i.e. if a phase-cut is being performed on the voltage input signal. The bleeder control arrangement responds to a detected phase-cut by issuing an output signal to activate the bleeder. This can then function as intended to ensure compatibility between the LED driver and the dimmer. If there is no dimmer present, i.e. there is no dimmer connected between the load and the power supply, the bleeder control arrangement according to the invention ensures that the bleeder is never activated. In this way, the bleeder is prevented from needlessly dissipating power in situations where there is no phase-cut being performed. Furthermore, the bleeder control arrangement operates independently of whether or not a dimmer is connected between the power supply and the load, greatly simplifying the design of a power-efficient product that must be made compatible with a dimmer, but which can be used with or without a dimmer.

According to the invention, the LED lamp driver is realized to drive a lighting load comprising a number of LED light sources, and comprises a bleeder control arrangement according to the invention.

An advantage of the LED lamp driver according to the invention is that the LED lamp driver is automatically compatible with any kind of phase-cut dimmer, but can just as well be used without a dimmer between it and a power supply. This makes it possible to manufacture a wide range of LED lamps with such LED lamp drivers for retro-fitting into existing lighting arrangements that may or may not already include a dimmer.

According to the invention, the lighting arrangement comprises a lighting load, wherein the lighting load comprises a number of LED light sources; a driver circuit realized to drive the lighting load; a bleeder for providing compatibility between a dimmer and the driver; and a bleeder control arrangement according to the invention realized to activate the bleeder only upon detection of a phase-cut edge on a power supply input signal.

An advantage of the lighting arrangement according to the invention is that an efficient operation of the LED lamp driver is ensured, even if there is no dimmer in use between the power supply and the load, or even if a dimmer is present but not active, i.e. the power supply input signal is not cut.

The dependent claims and the following description disclose particularly advantageous embodiments and features of the invention. Features of the embodiments may be combined as appropriate. Features described in the context of one claim category can apply equally to another claim category.

The voltage input to a driver of a lighting arrangement generally appears as a full-wave rectified signal, so that each 360° sinusoidal mains cycle phase is converted into two 180° half-waves. If a lighting arrangement comprises a phase-cut dimmer between the power supply and any driver electronics, and if the dimmer is active, some portion of each half-wave of the rectified power input signal will be cut, so that the 'conducting portion' is less than 180°. For example, a leading-edge phase-cut dimmer may suppress the first 15° portion of each half-wave, so that the conducting angle is reduced to 165°. The same conducting angle can be achieved by a trailing-edge phase-cut dimmer that suppresses or cuts the last 15° of each half-wave. In each case, the power supply signal is zero during the phase-cut portion.

Even if the phase-cut dimmer is not being used in its dimming mode, the maximum conducting angle is usually not quite 180° and can be a few degrees less; therefore in the following, whenever reference is made to the 'entire' or 'maximum' conducting angle, this can be understood to mean slightly less than 180° in the case of a present but inactive dimmer. The bleeder control arrangement according to the invention can deal with such a maximum conducting angle by appropriate choice of component, for example by appropriate choice of resistor values.

During dimming, the transition between zero and non-zero portions of the signal is a distinct edge. Therefore, in a particularly preferred embodiment of the invention, the bleeder control arrangement comprises an edge detection circuit portion realized to detect a phase-cut edge on the voltage input signal. The edge detection circuit preferably only responds to a sharp transition between zero and non-zero portions of the power supply input signal. This can be achieved using any suitable arrangement of analogue components. In a preferred embodiment of the invention, the edge detection circuit portion comprises a first-order series RC circuit, e.g. a capacitor in series with a resistor, to generate a pulse in response to a phase-cut edge on the voltage input signal. The pulse therefore signals the occurrence of an edge transition between zero and non-zero portions of the power supply signal, and can be used to perform an appropriate action, as will be explained below. The sudden rise or fall on the input voltage signal as a result of a phase-cut is detected by ohmic resistances connected in series with a capacitor of the RC high-pass circuit. However, the sudden steep rise (or fall) in voltage may damage electronic components of the circuitry. Therefore, in another preferred embodiment of the invention, the bleeder control arrangement comprises a voltage divider appended to the edge detection circuit portion. A voltage divider comprises two resistors in series, and the voltage output is taken from the node between the resistors. The values of resistance are chosen to ensure that the output signal is large enough to be useful but does not exceed a critical value that would possibly damage other electronic components.

The dimmer used in the lighting arrangement may be realized to perform leading-edge phase cutting, or may be realized to perform trailing-edge phase-cutting. Generally, the driver electronics and dimmer are designed and manufactured independently of each other, so that the driver has no 'information' about the dimmer with which it is to co-operate. Preferably, therefore, the edge detection circuit portion of the bleeder control arrangement according to the invention is realized to detect a rising phase-cut edge and/or a falling phase-cut edge on the voltage input signal. In this way, the driver does not need any specific information concerning the dimmer, but the bleeder control arrangement will always correctly activate the bleeder, regardless of whether the dimmer performs leading-edge or trailing-edge dimming. Equally, the bleeder control arrangement will always ensure that the bleeder remains inactive as long as there is no 'event' indicating a phase cut.

The bleeder control arrangement according to the invention can therefore extract the only relevant information from the power input signal, namely that the power input signal is phase-cut (a dimmer is evidently active); or the power input signal is not phase-cut (there is either no dimmer in use, or the dimmer is not active). In the following, but without restricting the invention in any way, it may be assumed that the power input signal is a voltage signal. The bleeder control arrangement therefore detects whether or not a portion has been 'cut' from the input voltage signal and activates or de-activates the bleeder accordingly.

The bleeder control arrangement according to the invention can use the pulse generated by the edge-detector to switch from one state to another. The change from one state to the other can occur once during each 180°, i.e. once during every half-wave of the full-wave rectified input signal, since a phase-cut event can occur at most once during such a 180° portion of the input signal. In a preferred embodiment of the invention, the bleeder control arrangement comprises a first transistor switch arranged to conduct in response to the pulse generated by the edge detection circuit portion. For example, the first transistor switch can be an NPN bipolar junction transistor (BJT), and the output of the edge detector can be connected to a terminal of the transistor switch. As long as the edge detector output is not sufficient to turn the first transistor switch on, this transistor switch will not conduct. However, when the edge detector outputs a pulse, the first transistor switch will conduct, i.e. it will be turned 'on'. For example, in the case of a leading-edge dimmer, the edge detector circuit portion will detect the rising edge on the voltage input signal and will output a positive pulse. Therefore, if this output is connected to the base terminal of the first transistor switch, it will turn on the first transistor switch whenever a pulse occurs, i.e. whenever a rising edge of a phase cut is detected on the input voltage signal. Similarly, in the case of a trailing-edge dimmer, the edge detector circuit portion will detect the falling edge on the voltage input signal and will output a negative pulse. Therefore, if this output is connected to the emitter terminal of the first transistor switch, it will turn on the first transistor switch whenever a pulse occurs, i.e. whenever a falling edge of a phase cut is detected on the input voltage signal.

The pulse output by the edge detector may be very short. The first transistor switch is therefore only briefly activated. However, this brief activation of the first transistor switch can be used to trigger a further switching action. In a preferred embodiment of the invention, the bleeder control arrangement portion comprises a second transistor switch arranged to conduct in response to a voltage drop caused by the conducting first transistor switch, and wherein the bleeder activation signal is generated at an output of the second transistor switch. For example, the base terminal of a PNP BJT can be connected to the collector of the first transistor switch. During the brief interval in which the first transistor switch conducts, a voltage drop can be effected at the base terminal of the second PNP transistor switch. This turns the second PNP transistor switch 'on'. The bleeder activation signal can then be derived from, for example, the emitter output of the second transistor switch. This output will remain 'on' or 'high' as long as the voltage at the base terminal of the second PNP transistor switch is low enough. The voltage drop at the base terminal of the PNP transistor can be effected in any suitable manner. In a particularly preferred embodiment of the invention, the bleeder control arrangement comprises a timing capacitor arranged to discharge through the first transistor switch. The sudden voltage drop caused by the sudden discharge through the first transistor switch has the effect of turning on the PNP second transistor switch. Since the edge detector pulse is only very brief in duration, the 'discharge path' is only open for a brief time, after which the timing capacitor can re-charge again. The value of the timing capacitor is preferably chosen to achieve a sufficiently 'slow' re-charge in order to keep the second transistor switch turned 'on' for the remainder of that voltage input half-cycle.

In the examples mentioned above, the first transistor switch is an NPN BJT, while the second transistor switch is a PNP BJT. Of course, a 'reverse' realization is equally possible, using a PNP BJT for the first transistor switch and an NPN BJT for the second transistor switch. Alternatively, instead of using BJTs, the transistor switches can be realized using field-effect transistors such as MOSFETs. The skilled person will be aware of the possibilities of using alternative transistor arrangements in analogue circuitry to respond to a pulse detected by an edge detector and to switch between the 'states' described above.

Under certain conditions, the edge detection or the response to the output of the edge detector may require assistance. For example, the discharge path of the timing capacitor may be limited. Therefore, in a preferred embodiment of the invention, the bleeder control arrangement also comprises a low-impedance path circuit portion arranged to assist in detection of a phase-cut edge on the voltage input signal. For example, a de-coupling capacitor may be used to transmit the falling edges generated by a trailing-edge dimmer, and at the same time to decouple a DC-bias between the edge detector circuit and the first switching transistor.

The amplitude of the edge detector output may in some cases be insufficient to reliably turn on the first transistor switch. Therefore, in a preferred embodiment of the invention, the bleeder control arrangement comprises an amplifying circuit portion for amplifying the output signal of the edge detection circuit portion. This can improve the performance of the bleeder activation circuit for short phase-cut portions, for example if only very little dimming is being done, and the conducting angle is close to 180°.

Depending on the types of transistor switch used, the output of the active second transistor (taken at its emitter) may have a low or a high voltage level. Using the example given above with a PNP BJT as second transistor switch, a dimmer performing a phase-cut results in an 'active high' signal at the emitter of the second transistor switch. This is the signal that will be used to activate the bleeder, since phase-cut is being performed. However, depending on the bleeder realization, it may be preferred to use a 'low' signal to activate the bleeder. Therefore, in a preferred embodiment of the invention, the bleeder control arrangement comprises a logic inverter to obtain a bleeder activation signal with the desired 'polarity'. For example, the logic inverter may be realized as a third transistor switch.

The bleeder control arrangement according to the invention can be realized as a self-contained module for connection between an existing dimmer and an existing electronic driver of a lamp. Such a module can then be used to retro-fit existing units and to improve the efficiency of an existing electronic driver while still ensuring compatibility between the driver and the dimmer. However, in a preferred embodiment of the invention, the bleeder control arrangement is incorporated in the driver circuit of a lamp. This simplifies the overall design, since the output of the bleeder control arrangement can be directly connected to the bleeder circuitry. The output signal from the bleeder control arrangement, indicating that the bleeder should be deactivated or activated as appropriate, can interface to an existing bleeder by means of appropriate circuit components. An exemplary arrangement will be described below.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

FIG. 8 shows a simplified circuit diagram of a fifth embodiment of a bleeder control arrangement according to the invention;

In the drawings, like numbers refer to like objects throughout. Objects in the diagrams are not necessarily drawn to scale.

DETAILED DESCRIPTION OF THE EMBODIMENTS

Figure 1:
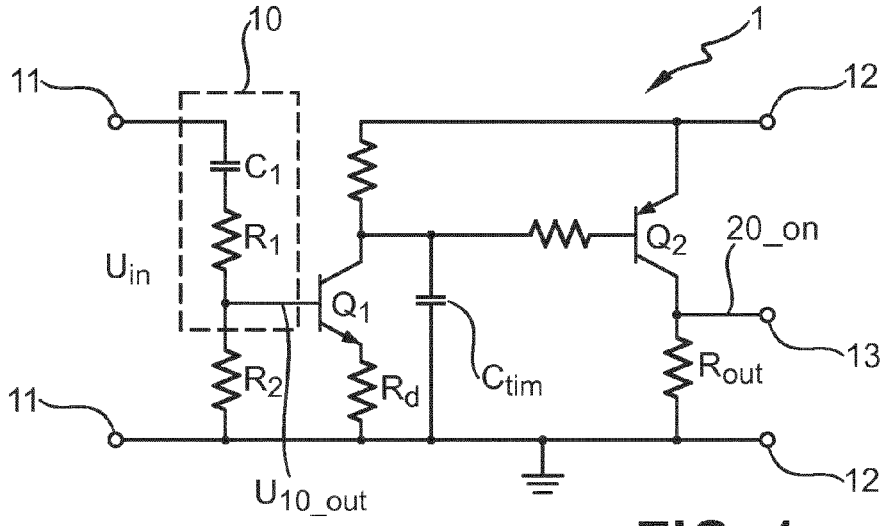
FIG. 1 shows a simplified circuit diagram of a first embodiment of a bleeder control arrangement according to the invention.

FIG. 1 shows a simplified circuit diagram of a first embodiment of a bleeder control arrangement 1 according to the invention, comprising an edge detector 10, a first transistor switch Q1, a timing capacitor $C_{tim}$, and a second transistor switch Q2. The bleeder control arrangement 1 is used to activate a bleeder of a lamp driver if a dimmer, connected between driver and power supply, is actively cutting portions of the power input signal. The input voltage $U_{in}$ to the bleeder control arrangement 1 will therefore be a rectified voltage signal that may or may not have been subject to phase cutting. The input voltage $U_{in}$ is applied across input terminals 11. An auxiliary voltage supply, from which a bleeder activation signal 20_on will be derived, is not shown here but will be understood to be connected across terminals 12. The first transistor switch Q1 is an NPN BJT, while the second transistor switch Q2 is a PNP BJT. A sharply increasing rising edge of a leading-edge phase-cut signal is detected by the edge detector 10, which responds by generating a positive pulse of a short duration. The edge detector 10 is realized as a simple first-order RC filter with a capacitor $C_1$ in series with a first resistor $R_1$. The output of the edge detector 10 is connected to the base terminal of the first transistor switch Q1, and is limited by a voltage divider comprising the first resistor $R_1$ and a second resistor $R_2$. The timing capacitor $C_{tim}$ is connected in parallel with the first transistor switch Q1. Therefore, when a positive pulse appears at the output of the edge detector 10, the ensuing relatively high base terminal voltage opens a discharge path for the timing capacitor $C_{tim}$ through the first transistor switch Q1. However, the charge across the timing capacitor $C_{tim}$ governs the voltage at the base terminal of the second transistor switch Q2, and therefore controls whether the second transistor switch Q2 is 'on' or 'off'. Therefore, when the timing capacitor $C_{tim}$ discharges through the path defined by the first transistor switch Q1 and resistor $R_d$, the resulting voltage drop turns the PNP transistor switch Q2 'on'. The bleeder activation signal 20_on goes 'high' and indicates that a bleeder should be activated since a phase-cut was detected. The bleeder activation signal 20_on appears across a resistor $R_{out}$ between the collector of the PNP transistor Q2 and ground. If a phase-cut had not been detected during a half-wave of the rectified input signal $U_{in}$, the edge detector 10 would not have generated an output pulse, both transistor switches Q1, Q2 would have remained 'off', and the bleeder activation signal 20_on would have remained 'low'.

Figure 2:
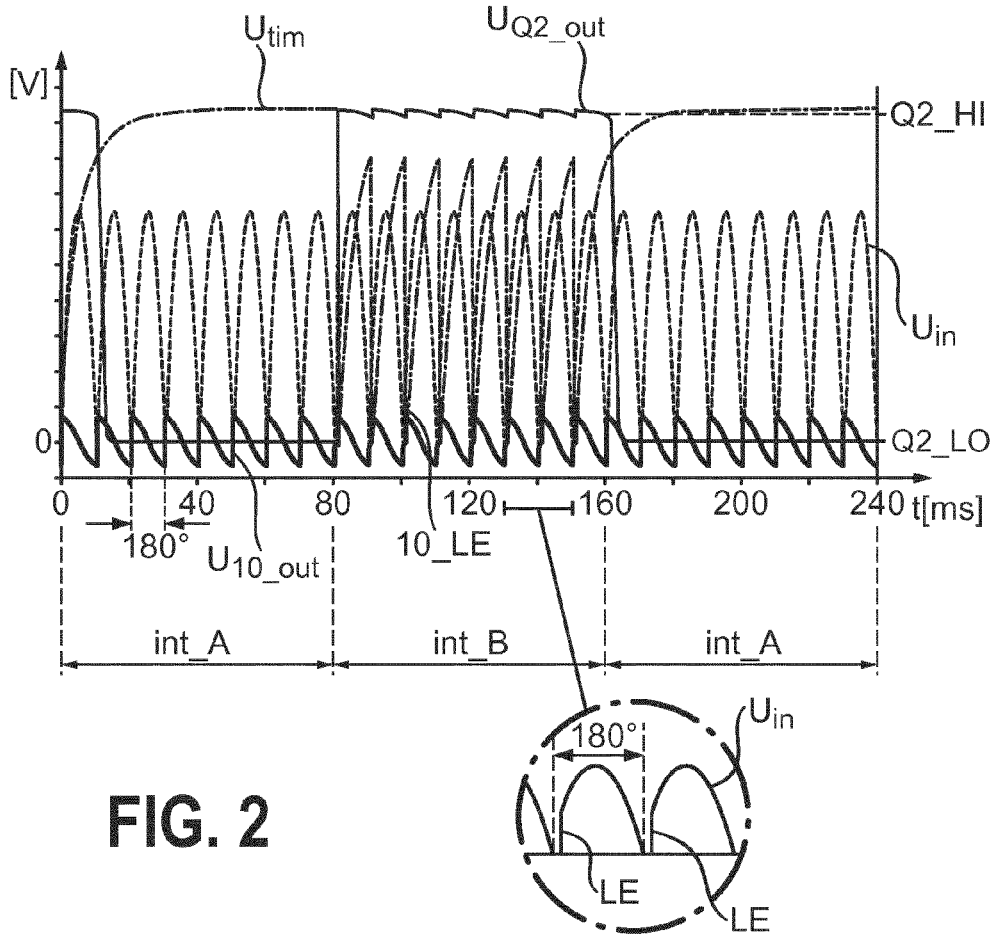
FIG. 2 shows graphs of relevant signals of the bleeder control arrangement of FIG. 1.

FIG. 2 shows graphs of relevant signals of the bleeder control arrangement of FIG. 1. An exemplary first interval int_A of eight rectified half-waves $U_{in}$ over which no phase-cut is performed is followed by an interval int_B spanning eight phase-cut half-waves; these in turn are followed by another interval int_A with eight half-waves over which no phase-cut is performed. Of course, the number of eight rectified half-waves in each interval is only chosen for the purposes of explanation, and it will be understood than an interval can span any length of time. In the diagram, during the phase-cut interval int_A, no phase-cut is being performed, so that the input voltage is present over the entire conducting angle. The output $U_{10_out}$ of the edge detector circuit 10 is therefore a simple oscillating signal with a maximum amplitude governed by the choice of RC components, chosen to be low enough to not turn on the first transistor switch Q1. During the phase-cut interval int_B, a small portion at the beginning of each rectified half-wave is suppressed or cut off (this is shown more clearly in the enlarged view spanning a few half-cycles, which uses a different scale to indicate a leading edge LE of a phase-cut input voltage signal $U_{in}$). The edge detector 10 responds by generating a pulse 10_LE on top of its usual output signal $U_{10_out}$. The amplitude of the pulse 10_LE will depend on the point at which the phase-cut is performed. If only a small portion of the phase is being cut, for example within the first 10° of each half-wave, the pulse 10_LE will be correspondingly small. When a large portion of the phase is being cut, for example at a point close to 90° of a half-wave, the pulse 10_LE will have a correspondingly high amplitude. In any case, the amplitude of the pulse 10_LE exceeds a minimum base voltage for turning on the first transistor switch Q1. The timing capacitor $C_{tim}$ can discharge through the first transistor switch Q1 during the brief period in which that transistor Q1 is turned on, so that the voltage at the base of the PNP transistor Q2 drops. The low voltage at the base of the PNP transistor Q2 turns it on, so that the voltage at the output 13, i.e. the signal $U_{Q2_out}$, switches from a low value Q2_LO to a high value Q2_HI. This signal will be used to activate a bleeder circuit of the driver of the lamp, as will be explained below.

Figure 3:
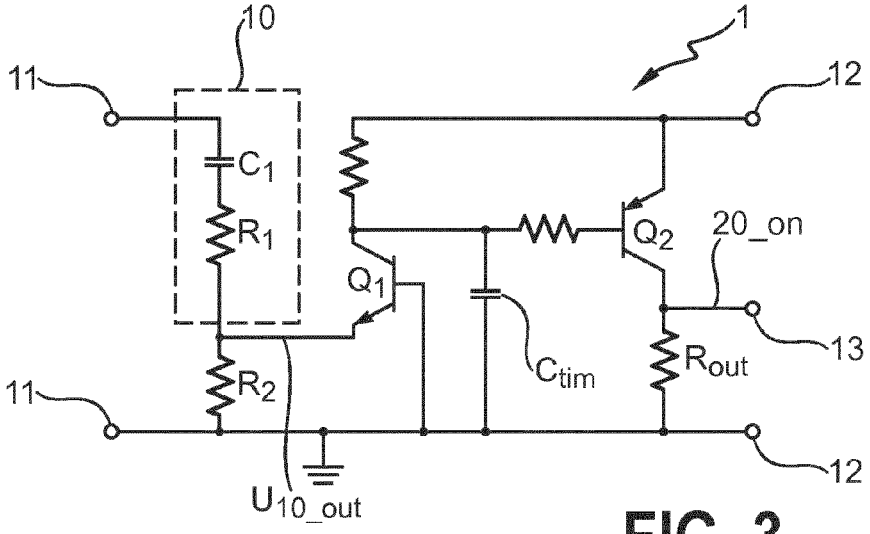
FIG. 3 shows a simplified circuit diagram of a second embodiment of a bleeder control arrangement according to the invention.

FIG. 3 shows a simplified circuit diagram of a second embodiment of a bleeder control arrangement 1 according to the invention. This embodiment is used to detect and respond to a trailing-edge phase cut on the input voltage signal. The circuit is largely identical to that of FIG. 1, but the output of the edge detector 10 is connected instead to the emitter of the first transistor switch Q1, which in this case is also an NPN BJT. A falling edge of a trailing-edge phase-cut signal is detected by the edge detector 10, which responds by generating a brief negative pulse, which again acts to open a discharge path for the timing capacitor $C_{tim}$ through the first transistor switch Q1 and resistor $R_2$. Again, the output of the bleeder control arrangement 1 is measured across a resistor $R_{out}$ between the collector of the PNP transistor Q2 and ground.

Figure 4:
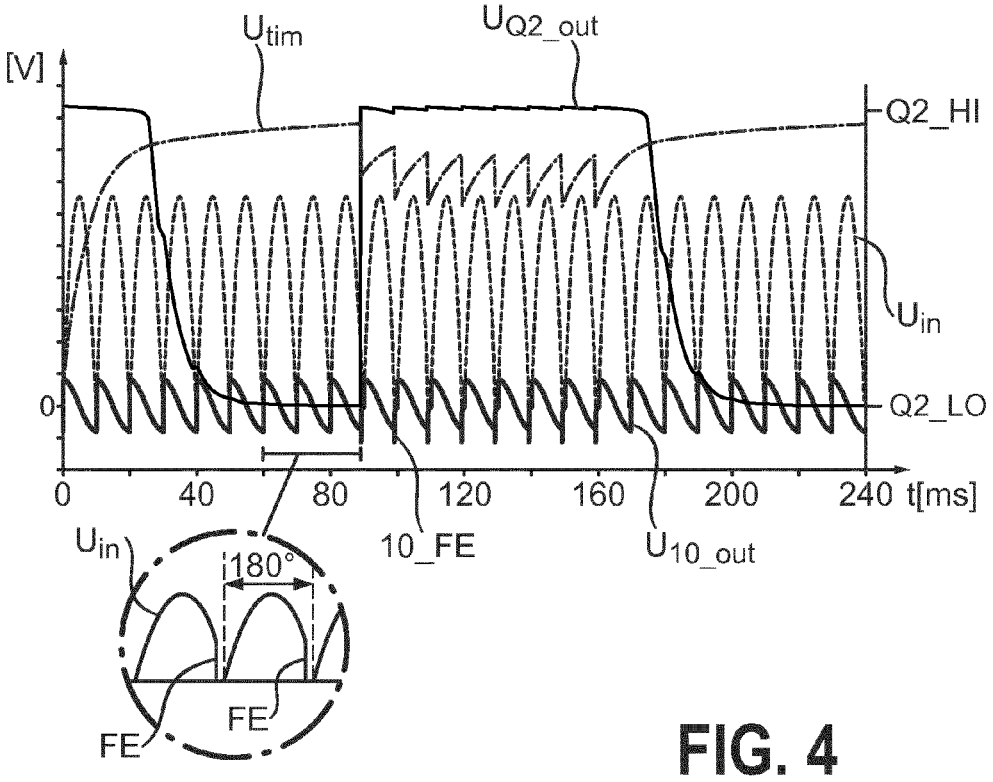
FIG. 4 shows graphs of relevant signals of the bleeder control arrangement of FIG. 3.

FIG. 4 shows graphs of relevant signals of the bleeder control arrangement of FIG. 3. The input voltage $U_{in}$ is again subject to phase-cutting during a phase-cut interval by a trailing edge dimmer. During inactive intervals, the input voltage is not subject to phase-cutting and has a conducting angle of essentially 180°. Here also, the output $U_{10_out}$ of the edge detector circuit 10 is an oscillating signal, in this case with a minimum amplitude chosen to be high enough to not turn on the first transistor switch Q1. During the phase-cut interval, a small portion at the end of each rectified half-wave is suppressed or cut off (shown more clearly, to a different scale, in the enlarged view of the indicated interval spanning a few cycles). The edge detector 10 responds to the falling edge FE by generating a negative pulse 10_FE. This negative pulse 10_LE is low enough to turn on the first transistor switch Q1, since its base is connected to ground and is therefore at a higher potential. The timing capacitor $C_{tim}$ can discharge through the first transistor switch Q1 during the brief period in which that transistor Q1 is turned on. Here also, the result is that the voltage at the base of the PNP transistor Q2 drops, so that the PNP transistor Q2 is turned on, as indicated by the signal $U_{Q2_out}$, so that the corresponding output signal 20_on switches from a low value Q2_LO to a high value Q2_HI, and will be used to activate a bleeder circuit of the driver of the lamp, as will be explained below.

Figure 5:
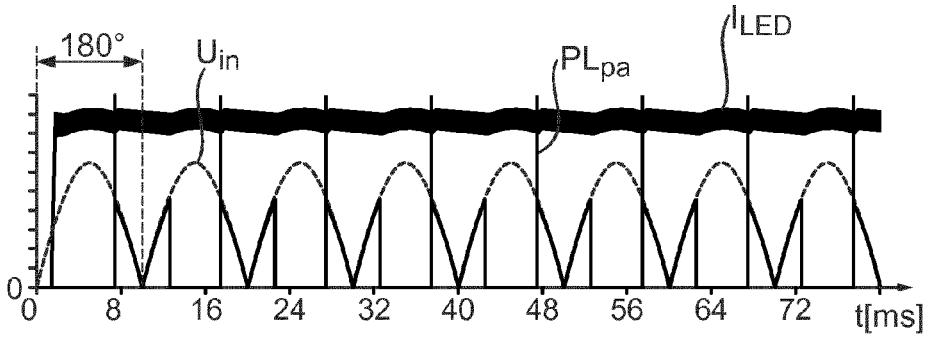
FIG. 5 shows graphs of voltage input, lamp current and power losses for a prior art lighting arrangement.

FIG. 5 shows graphs of voltage input $U_{in}$, lamp current $I_{LED}$ and power losses $PL_{pa}$ for a prior art lighting arrangement with a lamp driver incorporating a bleeder for compatibility with a dimmer. The diagram shows a situation when a dimmer is not present in the arrangement, or present but inactive (i.e. the light output is undimmed at 100%). Shortly after turning on the arrangement, the lamp current $I_{LED}$ reaches a relatively steady value. The 'band-like' appearance of the lamp current $I_{LED}$ is owing to the high switching frequency of the lamp driver electronics. The voltage input $U_{in}$ is a full-wave rectified input with a maximum conducting as shown here, since there is no phase-cut being performed. Therefore, when no dimming is being performed, the arrangement suffers from power losses $PL_{pa}$ associated with the bleeder. The level of dissipated power is particularly noticeable at the beginning and end of each half-wave, i.e. close to the commutation of the mains voltage signal, when the bleeder always draws current to ensure that the driver is compatible with any dimmer that might be present and operational. Clearly, these power losses are undesirable during intervals in which no dimming is being performed, and are very undesirable if the lighting arrangement does not even include a dimmer since the bleeder is not needed but results in increased power consumption.

Figure 6:
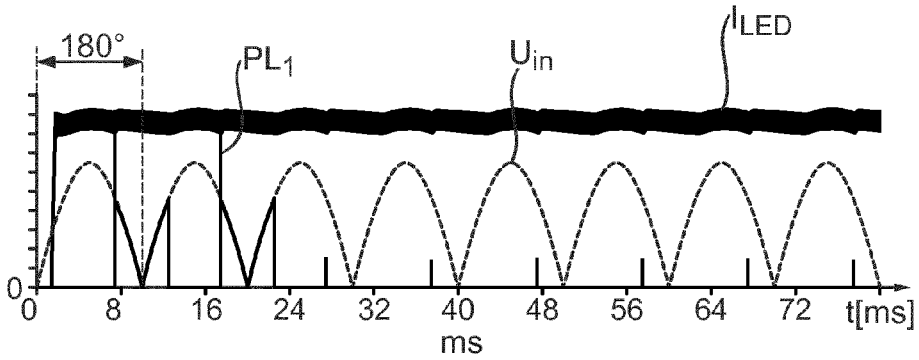
FIG. 6 shows graphs of voltage input, lamp current and power losses for a lighting arrangement according to the invention.

FIG. 6 shows graphs of voltage input $U_{in}$, lamp current $I_{LED}$ and power losses $PL_1$ for a lighting arrangement according to the invention, i.e. in which an embodiment of the analogue bleeder control arrangement described above is used to activate a bleeder only when required. Here also, the diagram shows a situation when a dimmer is not present in the arrangement, or present but inactive (i.e. the light output is undimmed at 100%). Lamp current $I_{LED}$ and voltage input $U_{in}$ are as described in FIG. 5 above. Here, the level of dissipated power is considerably reduced. Significant power loss levels are limited to the first few half-waves of the rectified input signal, since it takes a few cycles for the transistor switches and timing capacitors of the analogue bleeder control arrangement to be set up. Thereafter, power loss levels are negligible compared to the prior art situation in FIG. 5 above.

Figure 7:
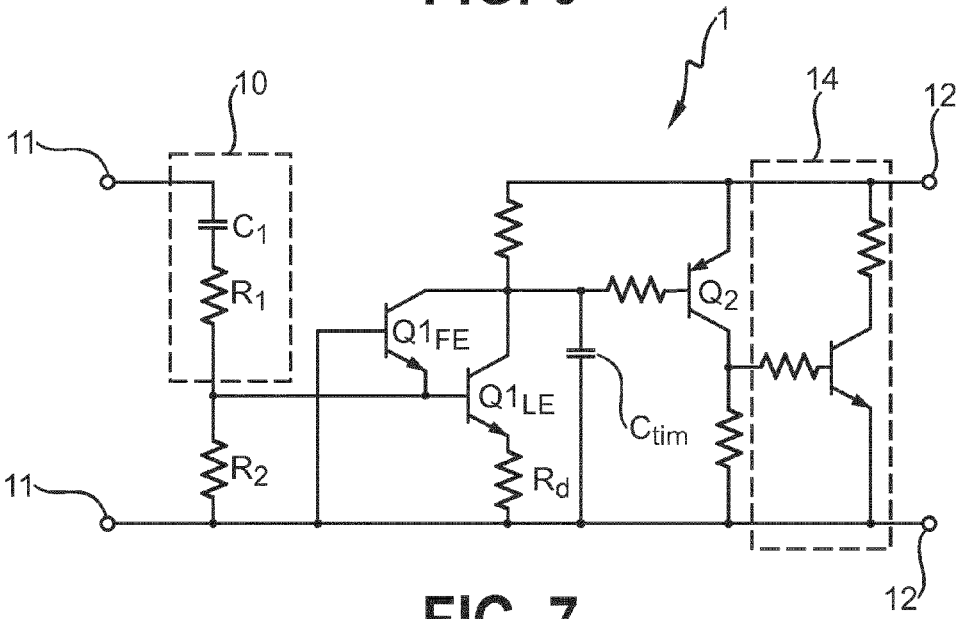
FIG. 7 shows a simplified circuit diagram of a third embodiment of a bleeder control arrangement according to the invention.

FIG. 7 shows a simplified circuit diagram of a third embodiment of a bleeder control arrangement 1 according to the invention. Here, the bleeder control arrangement 1 can detect and respond to both a leading-edge and a trailing-edge on a phase-cut signal. In other words, this embodiment of the bleeder control arrangement 1 can be used to detect the action of a leading-edge phase-cut dimmer and/or the action of a trailing-edge phase-cut dimmer. This embodiment is basically the embodiment of FIG. 1, extended to include the functionality of the embodiment of FIG. 3. Leading-edge detection is dealt with by a leading-edge transistor switch $Q1_{LE}$. Trailing-edge detection is dealt with by another transistor switch $Q1_{FE}$. This embodiment also shows a 'logic inverter' 14 which can be connected to the collector of the second transistor switch Q2 in order to obtain an output signal with inverted polarity, if such inversion is required. This additional circuitry can be provided so that the bleeder control arrangement can be connected to a wider range of lamp drivers, since there are many varieties of bleeder circuit, and some may be de-activated more easily using an activation signal that is 'active low'. The 'logic inverter' 14 can be used in any of the other embodiments disclosed herein.

Figure 8:
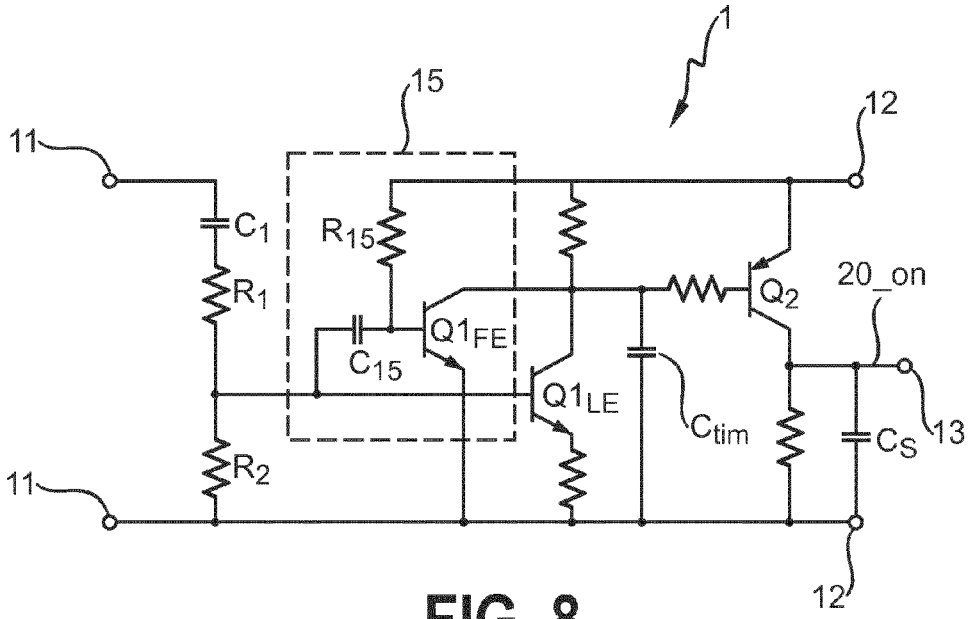
FIG. 8 shows a simplified circuit diagram of a fourth embodiment of a bleeder control arrangement according to the invention.

FIG. 8 shows a simplified circuit diagram of a fourth embodiment of a bleeder control arrangement 1 according to the invention. Here, the trailing edge detection of the circuit of FIG. 7 is improved by a low-impedance path circuit portion 15, which offers a low-impedance path to the timing capacitor $C_{tim}$ when a phase-cut trailing-edge has been detected. In this realization, the trailing-edge is detected using a PNP transistor switch $Q1_{FE}$ with a bias resistor $R_{15}$ connected to its base terminal. A decoupling capacitor $C_{15}$ is used to electrically decouple the resulting DC bias. This embodiment also makes use of a smoothing capacitor $C_s$ which serves to smooth the output signal 20_on. Of course, such a smoothing capacitor can be used in any of the other embodiments disclosed herein.

Figure 9:
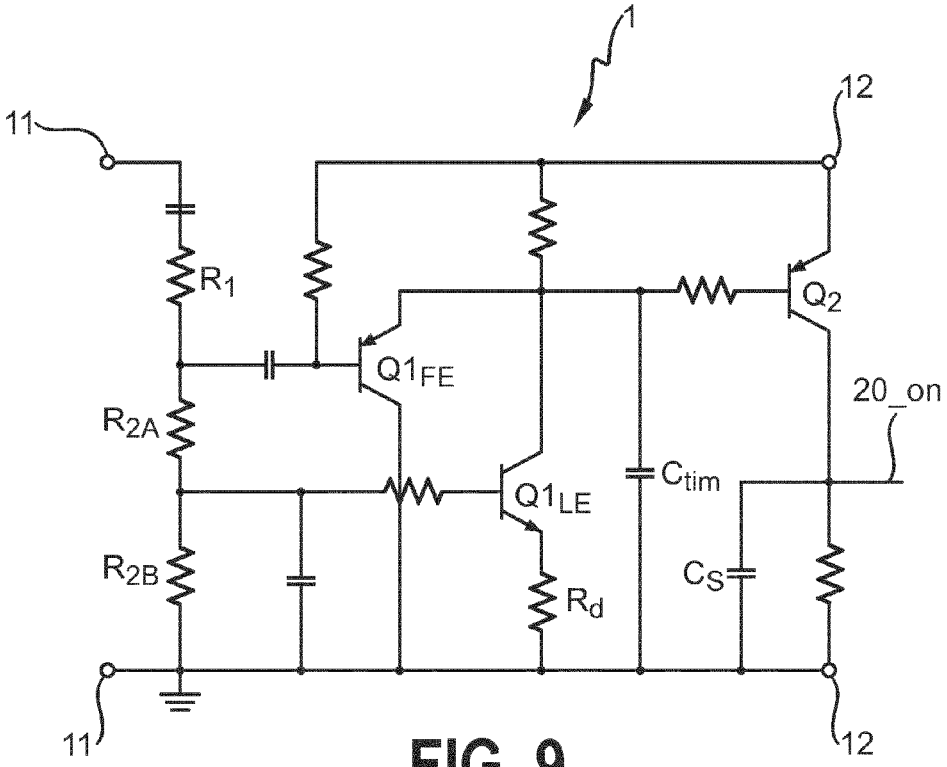

FIG. 9 shows a simplified circuit diagram of a fifth embodiment of a bleeder control arrangement 1 according to the invention. This embodiment is based on the embodiment of FIG. 8, and includes an improvement to the edge-detection circuitry. Here, the lower sense resistor $R_2$ shown in the preceding diagrams is replaced by two resistors $R_{2A}$, $R_{2B}$ in a voltage divider arrangement. This acts to increase the amplitude of a trailing-edge pulse generated by the edge detector 10, so that conducting angles that are close to 180° (i.e. with only very short phase-cut portions) will also be reliably detected by the bleeder control arrangement 1.

The bleeder control arrangement according to the invention offers an effective and reliable way of deactivating a bleeder during a time in which its function is not required, and achieves this with only a few relatively cheap analogue components. By de-activating the bleeder when it is not required, the efficiency of the lamp's driver electronics can be improved by several percent. For example, a very favorable improvement in efficiency from 73.5% to 82.4% has been measured in the course of experimentation with a lighting arrangement according to the invention based on the embodiment shown in FIG. 9.

Figure 10:
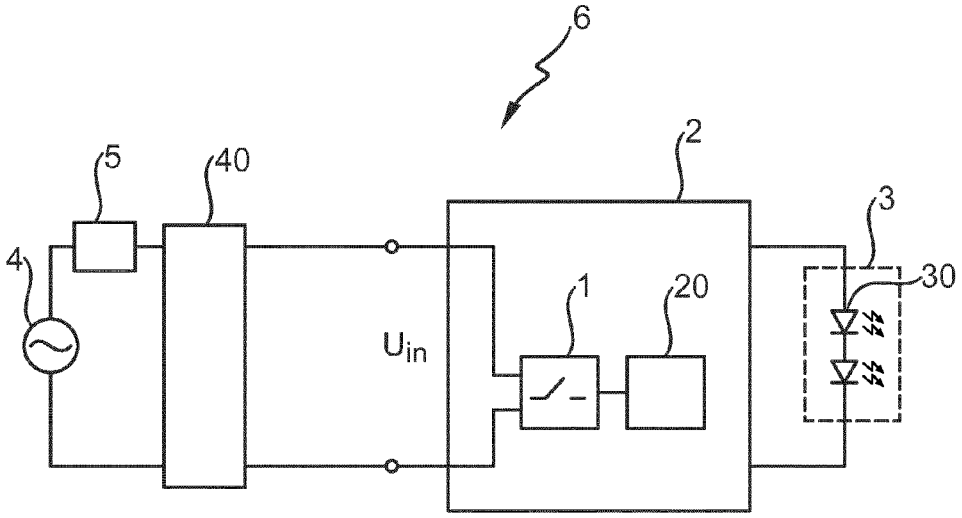
FIG. 10 shows a simplified block diagram of an embodiment of a lighting arrangement according to the invention.

FIG. 10 shows a simplified block diagram of an embodiment of a lighting arrangement 6 according to the invention. An LED lighting load 3 is driven by a driver 2. The driver 2 receives a full-wave rectified input voltage signal obtained from a mains power supply 4 and a full-wave rectifier 40. The full-wave rectified input voltage signal may also be subject to leading-edge or trailing-edge phase-cutting by a dimmer 5. To ensure compatibility with such a dimmer 5, the driver 2 comprises a bleeder 20. For power-efficient operation of the driver 2 when the dimmer 5 is not active, i.e. when the input voltage has a maximum conducting angle, the driver 2 comprises a bleeder control arrangement 1 according to the invention, for example as described in the preceding diagrams. The bleeder 20 is only activated by the bleeder control arrangement 1 if a phase-cut is detected, and this functionality of the bleeder control arrangement 1 is indicated by the switch symbol. Therefore, the bleeder 20 will only perform during phases in which the lighting load 3 is dimmed. Activation of the bleeder 20 is controlled by a suitable activation signal, for example the output signal 20_on taken from the second switching transistor Q2 as described in FIGS. 2 and 4; or an inverted output of the second switching transistor as described in FIG. 8, or a signal derived from such an output, etc. Of course, if there is no dimmer present, the activation signal remains at a level that ensures that the bleeder remains inactive.

Figure 11:
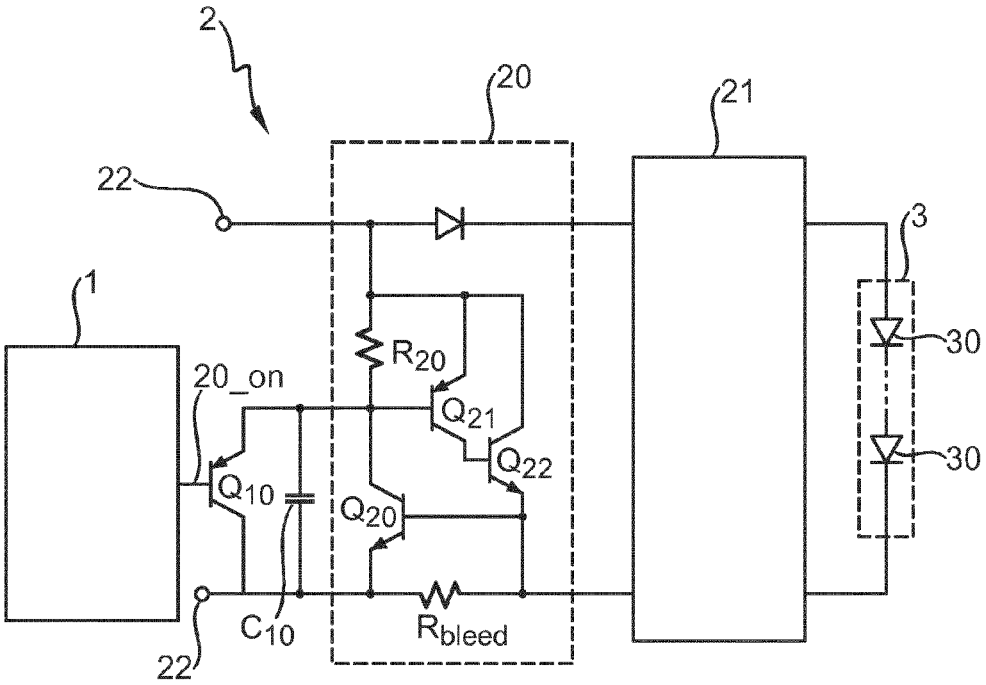
FIG. 11 shows a simplified circuit diagram of a bleeder circuit in a lighting arrangement according to the invention.

FIG. 11 shows a simplified circuit diagram of a bleeder 20 for use in a lamp driver such as the driver 2 shown in FIG. 10 above. Here the driver comprises, amongst other elements, a buck converter 21, a bleeder 20, and a bleeder control arrangement 1 according to the invention. The bleeder 20 is designed to draw a minimum (holding) current from the power supply, regardless of the current being drawn by the load. This commonly used type of bleeder is based on a current sink architecture, with a current sense resistor $R_{bleed}$, a control transistor $Q_{20}$ and a current drain comprising a resistor $R_{20}$ and a transistor Darlington stage $Q_{21}$, $Q_{22}$. When the current drawn by the driver is low, the voltage drop across the sense resistor $R_{bleed}$ is also reduced. This forces the control transistor $Q_{20}$ to get high ohmic, opening the Darlington stage $Q_{21}$, $Q_{22}$, which causes additional current to be drawn from the mains. Usually, if the driver 2 is not drawing any current from the mains (connected across terminals 22), the bleeder 20 is fully open, i.e. the maximum current is flowing through the bleeder 20. This maximum current depends on the minimum holding current of a triac of a phase-cut dimmer that may be connected between the driver 2 and the power supply. The bleeding function is only required when the driving electronics draws less current than the minimum holding current and if a phase-cut dimmer is active, i.e. if the conducting angle of the input voltage is less than its maximum conducting angle. Therefore, this means that for most LED drivers used in prior art arrangements, this type of bleeder causes significant high power losses (on average up to about 2.0 W) in the non-dimming state when the driver is drawing a low current.

Here, the bleeder 20 is controllable by an activation signal 20_on from a bleeder control arrangement 1 according to the invention. The bleeder 1 is connected to the bleeder 20 by means of an interface circuit with an activation transistor $Q_{10}$ and capacitor $C_{10}$. If phase-cut is being performed, the activation signal 20_on is 'high' (assuming positive 'polarity'), so that the activation transistor $Q_{10}$ (a PNP BJT) is 'off', the capacitor $C_{10}$ is fully charged, the Darlington stage $Q_{21}$, $Q_{22}$ is 'on', and the bleeder will function in the usual manner, i.e. drawing additional current through the Darlington stage $Q_{21}$, $Q_{22}$ from the power supply as required. If there is no dimmer being used, or if the dimmer is not performing any phase-cut, the activation signal 20_on is low, so that the activation transistor $Q_{10}$ is 'on', the capacitor $C_{10}$ discharges through the activation transistor $Q_{10}$, the Darlington stage $Q_{21}$, $Q_{22}$ is 'off', and the bleeder is prevented from drawing current from the power supply. The interface circuit can be realized as part of the bleeder circuitry, or as part of the bleeder control arrangement, as desired.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" does not preclude the use of more than one unit.

The invention claimed is:

1. An analogue bleeder control arrangement realized for use between a power supply and a load, which bleeder control arrangement is realized to generate a bleeder activation signal to activate a bleeder arranged between the power supply and the load, and wherein the bleeder activation signal is generated only upon detection of a phase-cut edge on a voltage input signal, the analogue bleeder control arrangement comprising an edge detection circuit portion realized to detect a phase-cut edge on the voltage input signal and to generate a pulse in response to a phase-cut edge on the voltage input signal and further comprising terminals configured to connect the analogue bleeder control arrangement to an auxiliary voltage supply;

a first transistor switch arranged to conduct in response to the pulse generated by the edge detection circuit portion;

a second transistor switch arranged to conduct in response to a voltage drop caused by the conducting first transistor switch, and wherein the bleeder activation signal is generated at an output terminal of the second transistor switch; and a timing capacitor arranged to discharge through the first transistor switch and to enable the second transistor switch when discharging.

2. A bleeder control arrangement according to claim 1, wherein the edge detection circuit portion is realized to detect a leading phase-cut edge and/or a trailing phase-cut edge on the voltage input signal.

3. A bleeder control arrangement according to claim 2, comprising a first transistor switch to conduct in response to the pulse of the leading phase-cut edge and a second transistor switch to conduct in response to the pulse of the trailing phase-cut edge.

4. A bleeder control arrangement according to claim 1, wherein the edge detection circuit portion comprises a first-order RC high-pass circuit realized to generate a pulse in response to a phase-cut edge on the voltage input signal.

5. A bleeder control arrangement according to claim 1, comprising a low-impedance path circuit portion arranged to assist detection of a trailing phase-cut edge on the voltage input signal.

6. A bleeder control arrangement according to claim 1, comprising a voltage divider appended to the edge detection circuit portion.

7. A bleeder control arrangement according to claim 1, comprising an amplifying circuit portion for amplifying the output signal of the edge detection circuit portion.

8. A bleeder control arrangement according to claim 1, comprising an inverting circuit portion realized to invert the polarity of the second transistor switch output.

9. A bleeder control arrangement according to claim 1, wherein the transistor switches comprise bipolar-junction transistors.

10. An LED lamp driver, realized to drive a lighting load comprising a number of LED light sources and comprising a bleeder control arrangement according to claim 1.

11. A lighting arrangement comprising a lighting load, wherein the lighting load comprises a number of LED light sources;

a driver circuit realized to drive the lighting load;

a bleeder for providing compatibility between a dimmer and the driver; and a bleeder control arrangement according to claim 1 realized to activate the bleeder only upon detection of a phase-cut edge on a power supply input signal.

12. A lighting arrangement according to claim 11, wherein the bleeder control arrangement is incorporated in the driver circuit.

* * * * *